United States Patent [19]

Minialoff et al.

[11] Patent Number: 4,713,921

[45] **Date of Patent: * Dec. 22, 1987**

[54] STUD FOR WALLS

[76] Inventors: Gerrard O. Minialoff; Martin J. Minialoff, both of P.O. Box 107, R.R. #1, Kleinburg, Ontario, Canada, L0J 1C0

[ * ] Notice: The portion of the term of this patent subsequent to Jan. 20, 2004 has been disclaimed.

[21] Appl. No.: 870,057

[22] Filed: Jun. 3, 1986

[51] Int. Cl.[4] ..... E04C 1/10

[52] U.S. Cl. ..... 52/579; 52/732; 52/588

[58] Field of Search ..... 52/364, 733, 481, 720, 52/638, 579, 588

[56] References Cited

U.S. PATENT DOCUMENTS

| | | | |
|---|---|---|---|
| 1,701,304 | 2/1929 | Jones . | |
| 1,913,342 | 6/1933 | Schaffert | 52/579 |
| 1,988,314 | 1/1935 | Higley . | |
| 2,026,278 | 11/1933 | Higley . | |
| 2,164,681 | 7/1939 | Fould | 52/588 |
| 2,424,080 | 7/1947 | Engstrom . | |
| 2,762,472 | 9/1956 | Jackson . | |
| 2,873,008 | 2/1959 | Ashman | 52/579 |
| 2,899,028 | 8/1959 | Walker | 52/579 |
| 3,049,198 | 8/1962 | Dobbins | 52/579 |
| 3,289,375 | 12/1966 | Cline . | |
| 3,531,902 | 10/1970 | Da Costa | 52/588 |
| 3,564,801 | 2/1971 | Huerta . | |
| 3,596,424 | 8/1971 | Ward . | |
| 3,618,281 | 11/1971 | Hill . | |
| 3,834,105 | 9/1974 | Powers . | |
| 3,913,292 | 10/1975 | Braekkan . | |
| 3,956,998 | 5/1976 | Bavetz | 52/481 |
| 3,968,603 | 7/1976 | Merson . | |
| 3,992,839 | 11/1976 | La Borde . | |
| 3,998,024 | 12/1976 | Frandsen . | |
| 4,075,810 | 2/1978 | Zakrzewski | 52/588 |
| 4,107,891 | 8/1978 | Cotton, Jr. . | |
| 4,283,897 | 8/1981 | Thompson . | |
| 4,461,134 | 7/1984 | Lowe . | |

FOREIGN PATENT DOCUMENTS

| | | | |
|---|---|---|---|
| 294390 | 10/1971 | Austria . | |
| 625693 | 8/1961 | Canada | 52/364 |
| 823364 | 9/1969 | Canada . | |
| 1683307 | 9/1970 | Fed. Rep. of Germany . | |
| 791124 | 9/1935 | France | 52/579 |
| 1229915 | 3/1959 | France . | |
| 2168400A | 6/1986 | United Kingdom | 52/588 |

*Primary Examiner*—Henry E. Raduazo

*Attorney, Agent, or Firm*—Rogers, Bereskin & Parr

[57] ABSTRACT

A stud for use in building structures is provided with a thermal break. The thermal break is formed by rows of slits with adjacent portions of the sheet material displaced relative to one another. This enables the stud to be formed by a simple rolling operation, without requiring a separate stamping operation to remove parts of the material. The stud can be formed integrally with an exterior panel, or can extend between interior and exterior panel portions of a combination panel.

10 Claims, 5 Drawing Figures

STUD FOR WALLS

This invention relates to a stud for walls of a building. This invention more particularly relates to a stud and to a combined stud and building panel, suitable for wall and roof constructions, which have inner and outer metal sheets or panels with insulation between them.

Steel and other metal panels are commonly used for cladding the exteriors of buildings. One known construction technique uses separate interior and exterior panels. This permits a layer of insulation to be provided between the interior and exterior panels. After the basic structural steel skeleton has been put up, the liner or interior panels are secured to the structural steel. Then, insulation is applied to the liner panels. For the exterior panels, sub-girts, which are typically of Z-section, have then to be secured to the liner panels and via the liner panels to the structural steel frame. Finally, the exterior panels can be secured to these sub-girts.

Such an assembly technique, whilst producing an acceptable cladding, is relatively complicated, and consequently requires a large amount of labor. Further, it is structurally necessary for the sub girts to extend between the inner and outer panels, thus creating thermal bridges. This causes excessive heat loss, and may cause condensation on the insde of the building.

It is desirable that a stud or sub-girt, forming part of a wall assembly, or integrally formed as part of a combination panel, should provide a thermal break, whilst being capable of simple and economical manufacture.

In accordance with the present invention, there is provided a panel formed from a single sheet of metal and comprising:

an exterior panel portion, which is generally planar and includes a first coupling channel extending adjacent a free edge of the exterior panel portion, and a second coupling channel extending adjacent an opposite edge of the exterior panel portion, for engaging a first coupling channel of another panel;

an interior panel portion, adapted to be overlied by an exterior panel portion, which interior panel portion is generally planar; and a stud extending between the interior and exterior panel portions and including a plurality of rows of slits extending along the length of the stud, with paths adjacent each slit being displaced relative to one another, with adjacent rows being spaced from one another and with the slits of adjacent rows staggered so that a bridging portion between two slits of one row is adjacent a slit of an adjacent row so as to reduce thermal conductivity between the interior and exterior panel portions.

The combined panel, of the present invention can be formed without requiring any parts to be cut or stamped out of the sheet material. This can greatly facilitate the manufacture of it. Usually, such studs and panels are formed by rolling and bending operations. If one wishes to remove material to form, for example, apertures for a thermal break, then it is is necessary to use a separate punching operation. This can greatly increase the cost of manufacture. In contrast, in the present invention, the thermal break is effected by slits, which do not require the removal of material, that instead rely upon parts or portions adjacent the slits being displaced relative to one another out of the plane of the material. Such slits can be formed on conventional roll forming machinery, and thus eliminate the necessity for additional punching or stamping machines and a separate production process.

The stud should have a depth, normal to the plane of the cladding for a wall, which is sufficient to permit insulation to be placed between interior and exterior panel portions.

Where one has a combined panel, including a stud portion and an exterior panel portion, it is a relatively simple matter to clad the walls of a building. After the basic structure or framework has been erected, one simply lays the combined panels in rows across each wall of the building. The inner surface of the stud portion is attached to the main structure, whilst the free edge of the exterior panel portion can overlap and be secured to an adjacent combined panel. Where desired, insulation panels or the like can be placed on the inside. Also, depending upon the building design, inner or liner panels can be laid simultaneously with the combined panels. In this case, one will usually lay the liner panels first, secure the insulation to them, and then finally attach the combined stud and exterior panels.

With regard to a combined panel, including a stud and interior and exterior panel portions, after assembly of the steel frame, a side of a building can be clad quickly and simply. If required, a separate inner panel portion of a panel defined above can be separated from the exterior panel portion and secured to the frame. The web portion can either be left attached to one of the inner and exterior panel portions, or it can be disposed of. The inner panel portion is then secured adjacent one edge of the side of the building. Insulation is placed on this inner panel portion and secured in position. A complete panel is secured in position adjacent to the already present inner panel portion. The inner panel portion of this next panel is secured to the structural steel, and the exterior or outer panel portion is placed over the insulation and secured to the already present inner panel portion. A second strip of insulation can then be located on the inner panel portion of this first complete panel. This cycle can be completed across the width or depth of the building, depending on the orientation of the panels, until the entire side of the building is covered.

Thus, in effect, as each panel is laid, it simultaneously provides an outer panel portion for one part of the surface, an inner panel portion for another part of the surface, and, in effect, a subgirt which would have to be provided separately in a known construction. If required to finish the surface, an exterior panel portion can be separated from a panel and secured adjacent another edge of the side of the building.

Panels of the present invention can be applied to any part of a building, including both walls and roof surfaces.

In the case of surfaces which require two or more rows of panels, it is convenient if all the rows of panels are laid simultaneously.

The insulation used can be any known insulation, such as fiberglass, or mineral fiber. Foam insulation can be used, and in this case it is conveniently applied by injection after both interior and exterior layers have been formed.

The number of slits and their arrangement can be varied, depending upon the dimensions of the stud. Typically, the number of rows of slits can vary in the range 3–10, depending upon the depth of the stud. The slits can be, for example, 3" long and the displaced marginal portions can be ⅜" deep.

For a better understanding of the present invention, and to show more clearly how it may be carried into effect, reference will now be made, by way of example, to the accompanying drawings which show embodiments of the present invention and in which.

Figure 1:
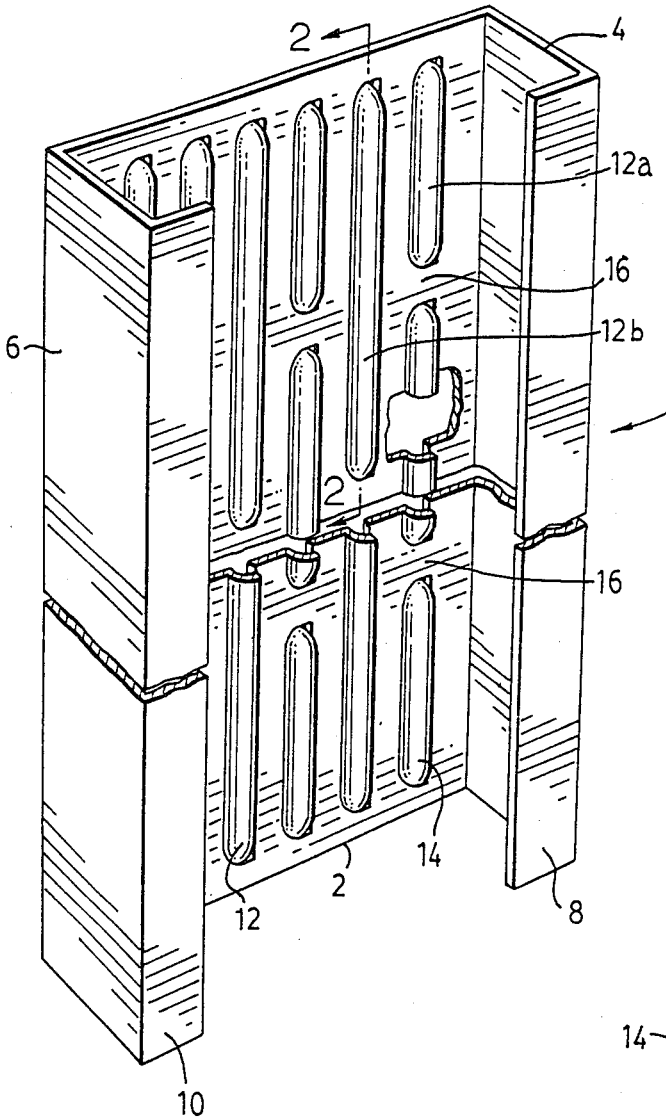
FIG. 1 is a perspective view of part of a stud in accordance with the present invention.

With reference to FIG. 1, there is shown a stud generally denoted by the reference 1. For clarity, just an end portion of the stud is shown. In general terms, the stud 1 is of indefinite length, and in use, would be cut or formed to a desired length.

The stud 1 is formed from sheet steel of uniform thickness. The stud 1 has a web 2. Extending along either side of the stud 1 is a respective edge portion 4 or 6. Further, extending from the edge portions 4, 6 are two respective flanges 8, 10, which are co-planar and parallel to the web 2. In use, the edge portions 4, 6 form interior and exterior surfaces of the stud 1. The flanges 8, 10 stiffen the edge portions 4, 6, and strengthen the stud 1.

The web 2 provides a bridge between the edge portions 4, 6, and hence could cause unnecessary and excessive heat loss. In accordance with the present invention, there are a plurality of rows of slits, which rows are generally designated by the reference 12. The individual slits are designated by the reference 14. The rows of slits extend along the length of the stud 1.

Two of the rows of slits are designated by the reference 12*a* and 12*b*, these two rows being adjacent to one another. As can be seen, the slits 14 or row 12*a* leave bridging portions 16 between adjacent slits 14. If the bridging portions of all the rows 12 were aligned, then they would provide a continuous conductive path across the width of the stud 1. For this reason, the rows 12 are staggered relative to one another. Thus, the slits 14 of the row 12*b* are located directly opposite the bridging portions 16. Equally, the slits 14 of the row 12*a* are opposite the bridging portions of the row 12*b*. Consequently, the heat conduction paths between the edge portions 4, 6 are tortuous, elongate and of narrow cross-section, so as to significantly reduce the heat transfer, even where the material of the stud has a relatively high thermal conductiviity.

Figure 2:
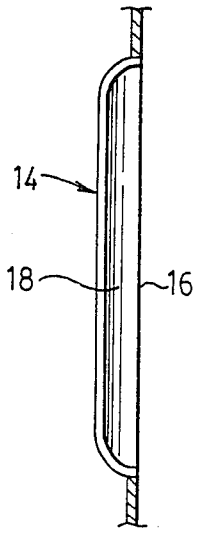
FIG. 2 is a side view, on a larger scale, of a slit of the stud of FIG. 1.

FIG. 2 shows a detail of one of the slits 14. The actual slit is indicated at 16. On one side of the slit, there is a strip of material, indicated at 18, which is pressed out of the plane of the web 2, to form a louvre. Consequently, even where the slit 16 is of no appreciable width, there is no thermal bridge formed between the strip of material 18 and a corresponding strip of material indicated at 20 on the other side of the slit 16.

With regards to dimensions, the slit 14 could be 3" long. The depth of the strip of material 18, as viewed in FIG. 2 could be ⅜", whilst it would be displaced over most of its height by ⅛". Naturally, the periphery of the strip of material 18, except for the actual slit 16, cannot be displaced by the full ⅛" as it has to merge with the main body of the web 2. The rows of slits 12 are spaced by 0.371", this being the distance between each slit and the edge of the strips of material 18 of the adjacent row 12. This gives a total spacing of approximately ¾".

A number of rows of slits will vary, depending upon the depth of the web 2. For a web 2 that is 3" deep, one could have 3–5 rows, whilst for a 4" deep web 2, one could have 5–7 rows of slits 14. For a web 2 which is 6" deep, one could have ten rows of 12 of the slits 14.

To maintain the structural integrity of the stud 1, the slits 14 do not extend right to the end of the stud 1. This will leave a continuous strip of material at either end, but this will have little effect on the overall thermal break effect.

By forming the thermal break using just slits 14, the stud 1 can be readily formed by a rolling machine. The sheet of material needs simply to be rolled, and all the slits 14 can be pressed out on one side of the sheet. Preferably, the slits 14 are pressed out facing the flanges 8, 10.

Figure 3:
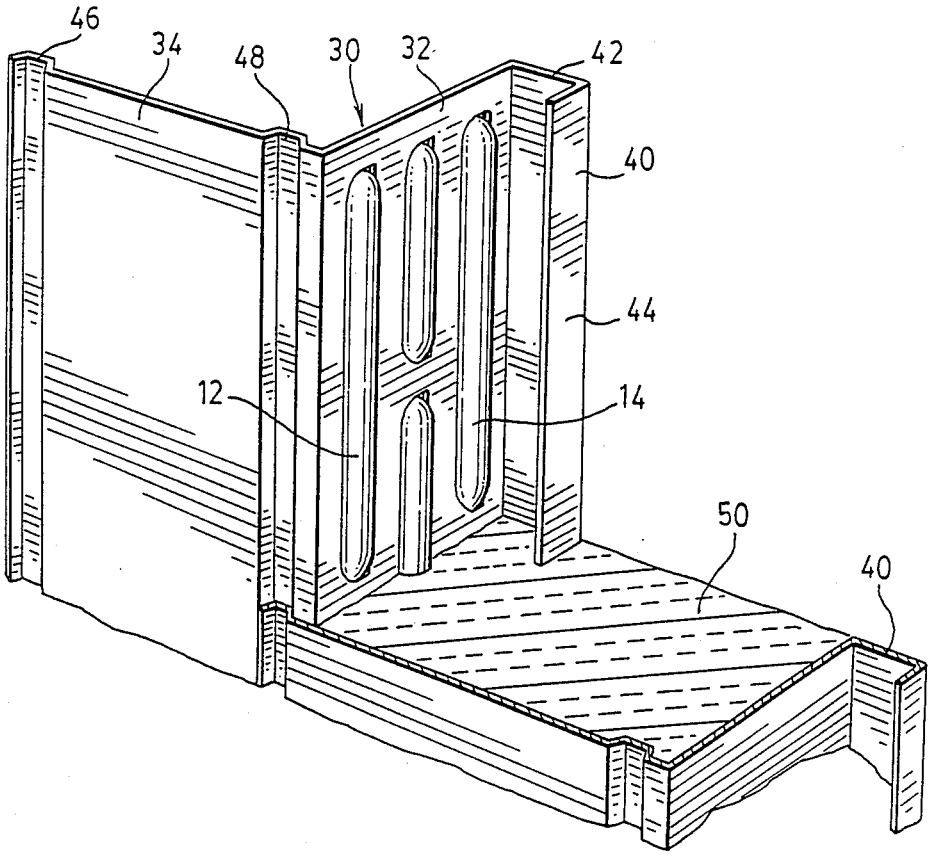
FIG. 3 is a perspective view of part of a cladding formed from a first combination stud and panel of the present invention.

Reference will now be made to FIG. 3, which shows a first embodiment of a combined stud and exterior panel portion, together forming a panel. This combined panel is denoted by the reference 30. The combined panel 30 includes the stud, denoted by the reference 32, and the exterior panel portion, denoted by the reference 34. The stud 32 is in the form of a web, and as before it includes rows of slits, here denoted 36 and 38 respectively. At its inner end, the stud 32 includes a channel-section 40. The channel section 40 has a base 42 and a side flange 44. In use, the channel section 40 would be secured to a structure of the building by means of screws or like passing through holes in the base 42.

The exterior panel portion 34 essentially comprises a single rectangular sheet. Along two opposite edges, there are provided channels 46, 48, for coupling purposes. The channel 46 is located immediately adjacent the left-hand edge of the exterior panel portion 34, as viewed in FIG. 1. The channel 48 is located adjacent the stud or web 32. These channels 46, 48 are of generally trapezoidal cross-section, and are adapted to nest in one another, as shown at the bottom of FIG. 3. For this purpose, the channel 46 would be slightly smaller than the channel 48, to allow for the thickness of the sheet material.

In use, the panels 30 are secured to a framework or support structure of a building, this structure not being shown in FIG. 3. The panels 30 are secured by means of screws or the like passing through holes in the channel sections 40. As shown, the panels 30 are located with their channels 46, 48 nested in one another, to form a continuous outer surface. Either before or after positioning the panels 30, insulation can be placed in the spaces formed between adjacent webs or studs 32, this insulation being indicated at 50. If desired, liner panels (not shown) can then be provided on the inner surface of the resulting wall structure.

Figure 4:
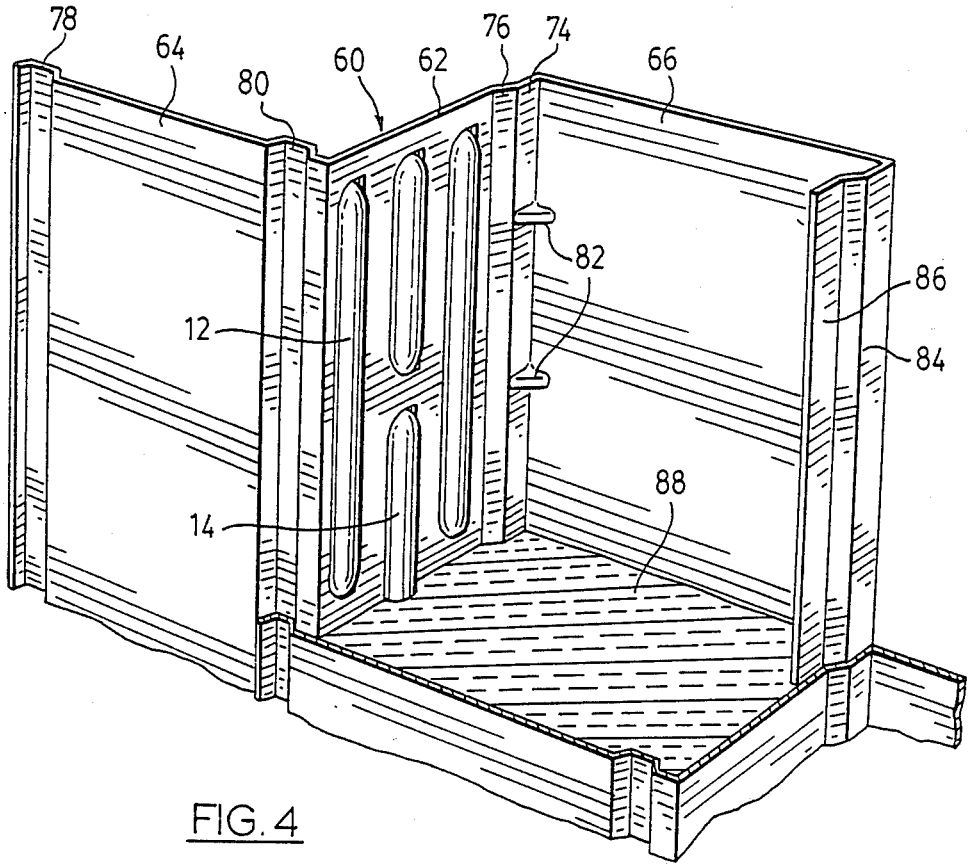
FIG. 4 is a perspective view of a cladding formed from a second combination panel and stud of the present invention.
Figure 5:
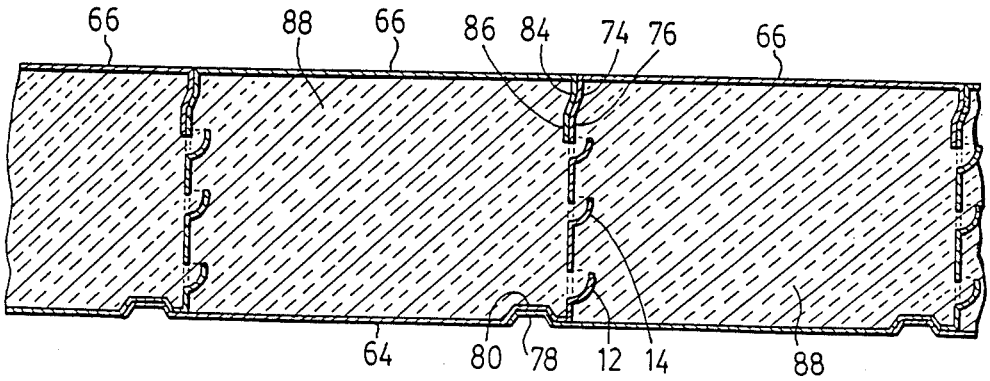
FIG. 5 is a cross-section through the cladding of FIG. 4.

Reference will now be made to FIGS. 4 and 5, which shown a combined panel, incorporating both interior and exterior panel portions and a stud or web. The whole panel is denoted by the reference 60. The stud or web is denoted by the reference 62, whilst the interior and exterior panel portions are denoted by the reference 64, 66 respectively. The stud or web 62 and the exterior panel portion 64 are similar to those described for the FIG. 3 embodiment.

The stud 62 includes rows 68 of slits 70 as before, the slits 70 are formed by louvres, here indicated by the reference 72. Further, the inner edge portion of the stud 62 is stepped in as indicated at 74, and includes a short inclined section 76. As explained below, this enables it to nest with the corresponding edge of the inner panel portion 66.

The exterior panel portion 64 includes two channels 78, 80, so that channels 78, 80 of adjacent panels can nest within one another as shown. As before, the channel 80 is of generally smaller section then the channel 78, corresponding to the thickness of the metal sheet.

The interior panel portion 66, like the exterior panel portion 64, comprises a rectangular sheet. It is joined to the stepped in section 74, and reinforced by gusset 82. These gussets 82 are optional.

The free edge of the interior panel portion 66 includes a stepped section 84, corresponding to the stepped section 74. This continues as a flange 86.

In use, first a supporting frame work, usually of steel beams, is assembled. Generally, it is then necessary to separate the interior panel portion 66 of one panel from the remainder of that panel. Conveniently, the interior panel portion 66 and the stud 62 are separated together. This part is then secured to the frame work along one edge of a wall or other surface, with the stud or web 62 along the actual edge itself. The interior panel portion 66 is screwed or otherwise secured to the frame at appropriate intervals. Then, insulation material, as indicated at 88 is attached to the mounted interior panel portion 66. The insulation can be a known insulation material such as fibreglass or mineral fibre.

A whole panel 60 can then be laid. Its exterior panel portion 64 is laid covering the previously laid insulation. Again, its interior panel portion 66 is secured to the frame work. As shown in FIG. 4, the step in section 74 is brought up against the stepped in section 84 of the interior panel portion 66, to help secure it. Once this whole panel 60 has been laid, then again insulation can be secured to its interior panel portion 66. For the first full panel 60 laid, it may be necessary or desirable to provide a special corner panel, connected to the channel 78. One can then continue to lay panels 60 and insulation 88 across the width of the wall. Each panel 60 is secured by screws through its interior panel portion 66 to the support structure. Also, the nested channel 78, 80 can be secured together by screws or the like.

Once the final panel 60 has been laid, and insulation placed on it, the insulation will be uncovered. Accordingly, if desired, the exterior panel portion 64 and stud 62 of a panel can be separated from the corresponding interior panel portion 66, and secured in position to cover this insulation. Again, a special corner piece or an end piece can be used to finish the surface.

The preceding description of the assembly technique for the combination panel 60 is based on the assumption that the length of the panels 60 will correspond to the height or width of the surface. In cases, where it is necessary to use two or more rows of panels to cover the entire surface, it is preferable that the rows of panels are laid simultaneously. Thus, for a two row surface, one would first position two separate interior panel portions 66 on the frame work. After laying appropriate insulation, two complete panels 60 can be laid and secured overlapping oneanother. This procedure would be continued, to form the two rows simultaneously across the surface.

Further, although the described assembly technique requires the provision of separate interior and exterior panel portions at corners, this may not be necessary. At corners, one could provide special panels which provide an interior panel portion on one side of a building and an exterior panel portion on an adjacent side of the building.

We claim:

1. A panel formed from a single sheet of metal and comprising:

an exterior panel portion, which is generally planar and includes a first coupling channel, which has a shallow, trapezoidal cross-section and extends adjacent a free edge of the exterior panel portion, and a second coupling channel, which has a shallow trapezoidal cross-section and which extends adjacent an opposite edge of the exterior panel portion, for engaging a first coupling channel of another panel, each of the trapezoidal cross-sections including inwardly inclined sides and a central planar portion parallel to the exterior panel portion;

an interior panel portion, adapted to be overlied by an exterior panel portion, which interior panel portion is generally planar; and a stud extending between the interior and exterior panel portions and including a plurality of rows of slits extending along the length of the stud with parts adjacent each slit being displaced relative to one another, with adjacent rows being spaced from one another and with the slits of adjacent rows staggered so that a bridging portion between two slits of one row is adjacent a slit of an adjacent row so as to reduce thermal conductivity between the interior and exterior panel portions.

2. A panel as claimed in claim 1, wherein all the slits are of the same length.

3. A panel as claimed in claim 2, wherein each bridging portion between two slits of one row is adjacent the mid-point of a slit of an adjacent row.

4. A panel as claimed in claim 1, 2 or 3, wherein each slit is formed by a louvre of corresponding length pressed out along one side of the slit.

5. A panel as claimed in claim 1, wherein each slit is formed by a louvre pressed out of the stud along one side of the slit, and all the louvres being pressed out on the one side of the stud, and in cross-section, extending through a quadrant.

6. A panel as claimed in claim 5, wherein each louvre is 3 inches long and $\frac{3}{8}$'s of an inch wide, with the louvres of each row being spaced by 174 of an inch.

7. A panel as claimed in claim 5 or 6, wherein the rows of louvres are 0.371 inches apart.

8. A panel formed from a single sheet of metal and comprising:

an exterior panel portion, which is generally planar and includes a first coupling channel, which has a shallow, trapezoidal cross-section and extends adjacent a free edge of the exterior panel portion, and a second coupling channel, which has a shallow, trapezoidal cross-section and which extends adjacent an opposite edge of the exterior panel portion, for engaging a first coupling channel of another panel;

an interior panel portion adapted to be overlied by an exterior panel portion, which interior panel portion is generally planar and includes a freee edge adapted to abut a stud of an adjacent panel; and a stud extending between the interior and exterior panel portions and including a plurality of rows of slits extending along the length of the stud, with parts adjacent each slit being displaced relative to one another, with adjacent rows being spaced from one another and with the slits of adjacent rows staggered so that a bridging portion between two slits of one row is adjacent a slit of an adjacent row so as to reduce thermal conductivity between the interior and exterior panel portions.

9. A panel as claimed in claim 1 or 8, wherein the stud includes a stepped-in section adjacent the interior panel portion, and the interior panel portion includes an outwardly extending flange including a corresponding stepped section, the stepped sections of adjacent panels nesting within one another.

10. A panel as claimed in claim 1 or 8, wherein the stud includes a stepped-in section adjacent the interior panel portion that is reinforced with gussets, and the interior panel portion includes an outwardly extending flange including a corresponding stepped section, the stepped sections of adjacent panels nesting within one another.

* * * * *